United States Patent [19]

Nakagawa et al.

[11] 4,125,994

[45] Nov. 21, 1978

[54] TRAIN STRUCTURE OF A TIMEPIECE

[75] Inventors: Yasuichi Nakagawa; Masataka Ikenishi; Shozo Kushida; Hirokazu Tsukutani, all of Tokyo, Japan

[73] Assignee: Kabushiki Kaisha Daini Seikosha, Japan

[21] Appl. No.: 730,206

[22] Filed: Oct. 6, 1976

[30] Foreign Application Priority Data

Oct. 7, 1975 [JP] Japan ..... 50-137100

[51] Int. Cl.[2] ..... G04B 33/10

[52] U.S. Cl. ..... 58/59; 58/2; 58/57

[58] Field of Search ..... 58/4 A, 4 R, 7, 57, 58/58, 59, 2

[56] References Cited

U.S. PATENT DOCUMENTS 3,350,873 11/1967 Egger ..... 58/4 R 3,939,645 2/1976 Charbonney ..... 58/4 R

*Primary Examiner*—Robert K. Schaefer

*Assistant Examiner*—Leonard W. Pojunas, Jr.

*Attorney, Agent, or Firm*—Robert E. Burns; Emmanuel J. Lobato; Bruce L. Adams

[57] ABSTRACT

A timepiece gear train structure comprises a center wheel and pinion mounted between a third wheel bridge and a date wheel holder without use of a train wheel bridge as is customarily used in such gear train structures. A plate extends between the third wheel bridge and the date wheel holder and has an opening therein through which extends the intermediate part of the center wheel and pinion thereby rotably supporting the intermediate part thereof. The lower part of the center wheel and pinion is rotatably supported by the date wheel holder by means of a cannon pinion which encircles the lower part, an hour wheel which encircles the cannon pinion and a bush encircling a portion of the hour wheel and being fixed to the date wheel holder.

3 Claims, 2 Drawing Figures

TRAIN STRUCTURE OF A TIMEPIECE

BACKGROUND

This invention relates to a gear train structure of a timepiece.

An essential component of the conventional gear train structure comprises a trainwheel bridge for supporting the center wheel and pinion of the timepiece. Therefore the train-wheel bridge is structually necessary and the cost of manufacture and assembly of the train-wheel bridge affects the price of the timepiece.

On the other hand, the train-wheel bridge is an obstacle in making the timepiece thinner.

This invention effectively reduces the cost of manufacture of the timepiece and permits formation of a thinner timepiece by excluding the train-wheel bridge thereby eliminating the above mentioned difficulties and insufficiencies.

DETAILED DESCRIPTION OF INVENTION

Figure 1:
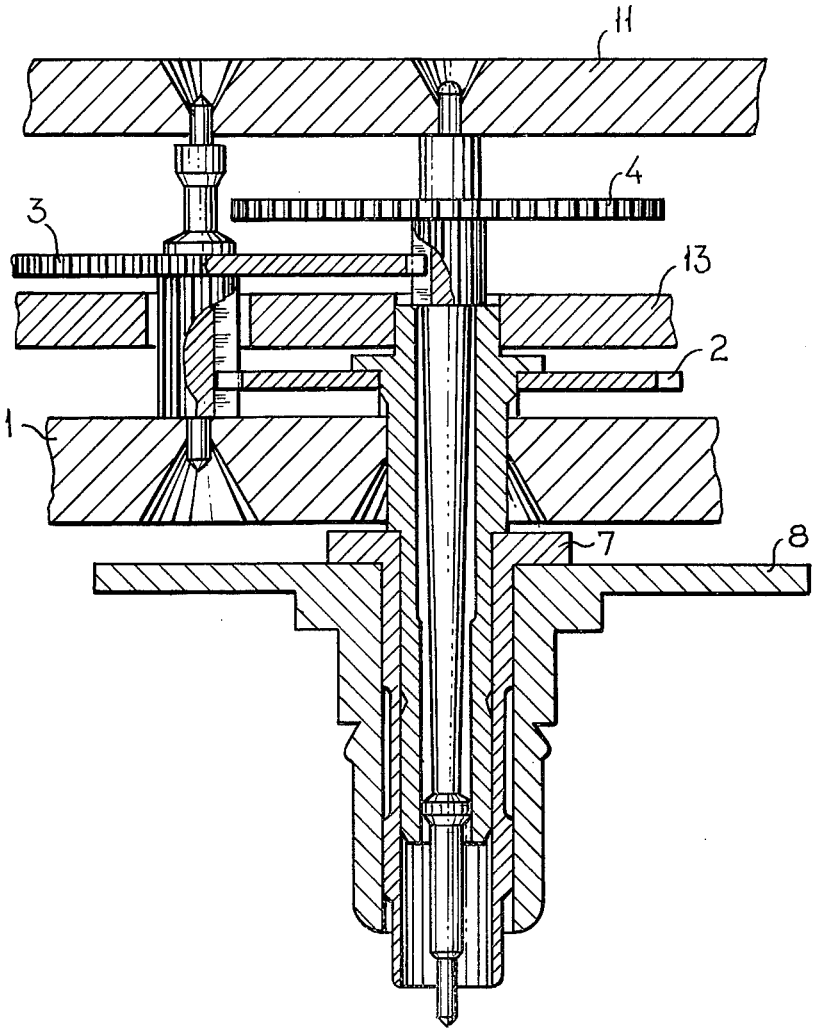
FIG. 1 is a sectional view of a conventional gear train structure which includes a train-wheel bridge.

Referring first to the conventional gear train structure shown in FIG. 1, a base plate 1 has an opening therethrough which rotatably supports the lower end of a center wheel and pinion 2 and a train-wheel bridge 13 has an opening therethrough which rotatably supports the upper end thereof. A third wheel and pinion 3 is rotatably mounted between the plate 1 and a third wheel bridge 11 and a fourth wheel and pinion 4 is rotatably mounted between the bridge 11 and the upper end of the center wheel and pinion 2. It can be easily appreciated that the presence of the train-wheel bridge limits the spacing or distance between the center wheel 2 and the third wheel 3 and prevents these wheels from being positioned closer together thereby preventing formation of a thinner timepiece.

Figure 2:
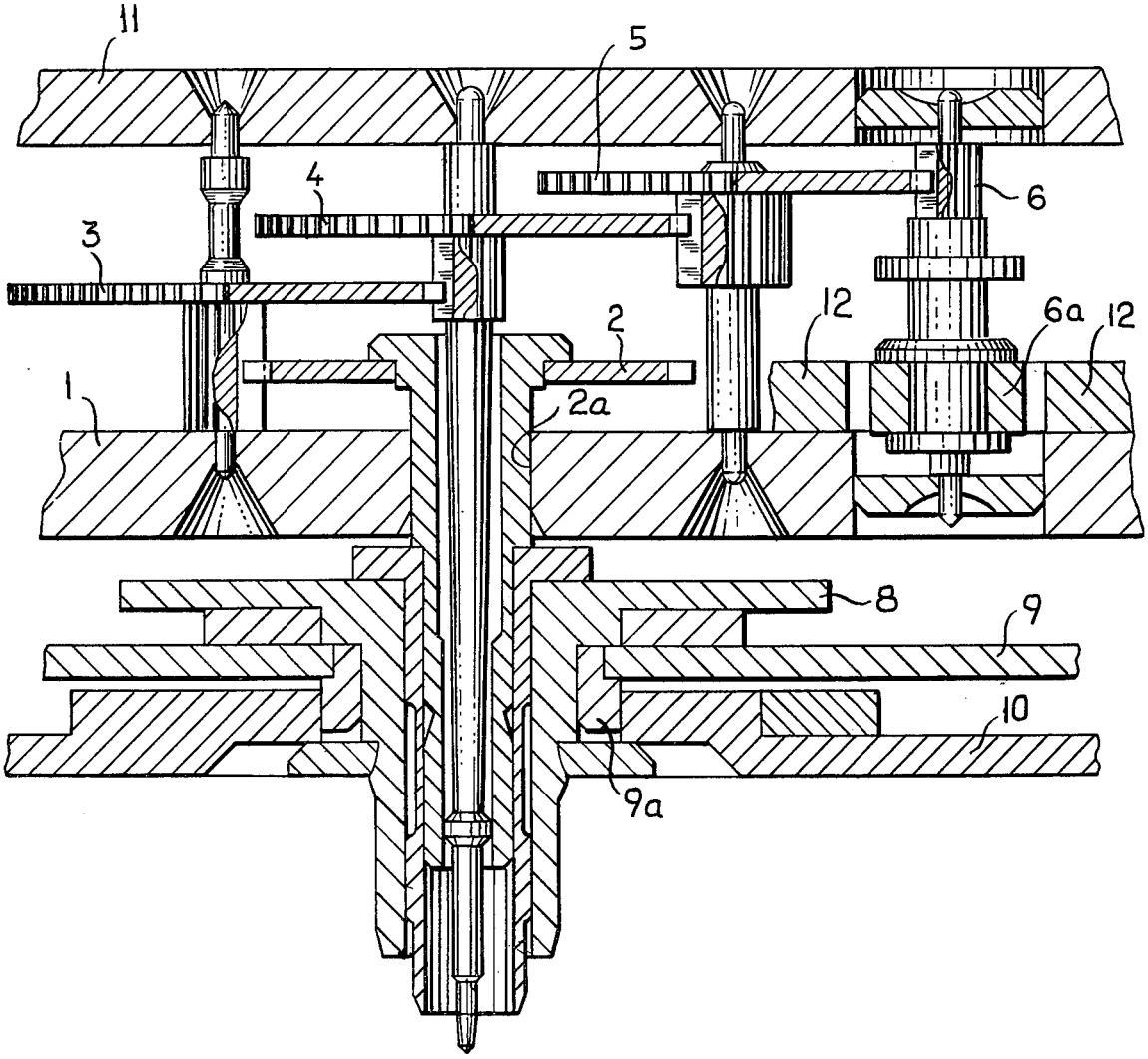
FIG. 2 is a sectional view showing an embodiment of the gear train structure of the present invention.

Referring now to the gear train structure of the invention shown in FIG. 2, the same reference numerals have been used as in FIG. 1 to denote the same or similar parts.

In FIG. 2, reference numeral 1 is a plate, 2 is a center wheel and pinion, 3 is a third wheel and pinion, 4 is a fourth wheel and pinion, 5 is a fifth wheel and pinion and 6 is a rotor. Reference numeral 7 is a cannon pinion frictionally connected to the center wheel and pinion 2 for rotation therewith, 8 is an hour wheel, and 9 is a date wheel holder which coacts with a jumper lever portion (not shown) to position a date wheel and a day wheel. To a center portion of the date wheel holder 9 is fastened a bush **9*a* to guide the hour wheel 8 and a day star with dial disk 10. The center wheel and pinion 2 is therefore supported at its lower end (beneath the plate 1) by the combination of the bush 9*a*, the cannon pinion 7 and the hour wheel 8. Numeral 11 is a third wheel bridge which supports each of the upper end shafts of the above mentioned rotor 6, fifth wheel and pinion 5, fourth wheel and pinion 4, and third wheel and pinion 3. Numeral 12 is a stator positioned at both sides of the rotor 6** both ends of which (not shown) are connected to a coil block (not shown) in a manner well known in the art.

During operation, alternate magnetic fields N,S are developed at both sides of the stator 12 by the action of a circuit block (not shown) and coil block including battery (not shown) and quartz crystal vibrator (not shown). Then the rotor 6 rotates and the rotary power is transmitted to the center wheel and pinion 2 by way of the fifth wheel and pinion 5, the fourth wheel and pinion 4, and the third wheel and pinion 3. The above mentioned rotary driving action is the same as that of the conventional type timepiece gear train. However, unlike the conventional gear train, intermediate part or portion of the center wheel and pinion 2 of the inventive gear train structure is supported by the plate 1 and the lower part or portion thereof is supported by the bush **9*a* of the date wheel holder 9 through the cannon pinion 7 and the hour wheel 8**.

The gear train structure of the present invention is of simpler construction than those of the prior art in that the train-wheel bridge which was conventionally necessary has been omitted. Accordingly it is possible to reduce the cost of manufacture including the cost of the train wheel bridge and the assembling operation. Moreover it is possible to produce a thinner timepiece because the train-wheel bridge is omitted.

We claim:

1. In a timepiece gear train structure of the type having a third wheel bridge, a plate and a date wheel holder disposed in superposed spaced-apart relation; and a center wheel and pinion extending through an opening in said plate: means mounting said center wheel and pinion for rotational movement comprising the portion of said plate which defines said opening for rotatably supporting an intermediate part of said center wheel and pinion; and means for rotatably supporting the lower part of said center wheel and pinion on said date wheel holder comprising a cannon pinion disposed over and connected to the exterior portion of said lower part of said center wheel and pinion, an hour wheel disposed on the exterior portion of said cannon pinion, and a bush disposed around the exterior of said hour wheel and being fixed on said date wheel holder.

2. A timepiece gear train structure according to claim 1; further including a fourth wheel and pinion rotatably mounted on said third wheel bridge and being disposed coaxially with said center wheel and pinion with no intervening plate or bridge therebetween.

3. In a timepiece gear train structure of the type having a third wheel bridge, a plate and a date wheel holder disposed in superposed spaced-apart relation; and a center wheel and pinion extending through an opening in said plate: means mounting said center wheel and pinion for rotational movement comprising the portion of said plate which defines said opening for rotatably supporting an intermediate part of said center wheel and pinion; means for rotatably supporting the lower part of said center wheel and pinion on said date wheel holder; and a fourth wheel and pinion rotatably mounted on said third wheel bridge and being disposed coaxially with said center wheel and pinion with no intervening plate or bridge therebetween.

* * * * *